US005466057A

United States Patent [19]

Blankenburg

[11] Patent Number: 5,466,057

[45] Date of Patent: Nov. 14, 1995

[54] MODULAR STORAGE APPARATUS

[76] Inventor: Karl Blankenburg, 32131 Claeys Dr., Warren, Mich. 48093

[21] Appl. No.: 213,987

[22] Filed: Mar. 16, 1994

[51] Int. Cl.[6] ..... A47B 87/00; F16B 12/00

[52] U.S. Cl. ..... 312/108; 312/111; 312/140

[58] Field of Search ..... 312/108, 111, 312/117, 140, 245, 265–265.5, 257.1, 263, 264; 108/153, 180, 185; 211/194, 189, 186, 191; 403/217, 265

[56] References Cited

U.S. PATENT DOCUMENTS

| | | | |
|---|---|---|---|
| 2,513,951 | 7/1950 | McClellen . | |
| 3,183,574 | 5/1965 | Diem . | |
| 3,254,773 | 6/1966 | Diem . | |
| 3,661,434 | 5/1972 | Alster | 312/108 X |
| 3,754,805 | 8/1973 | Panqburn et al. . | |
| 3,836,218 | 9/1974 | Hallal | 312/108 X |
| 3,913,289 | 10/1975 | Recker . | |
| 3,955,510 | 5/1976 | Kinik et al. | 312/108 X |
| 3,975,877 | 8/1976 | Walton . | |
| 3,977,742 | 8/1976 | Rovere | 312/263 X |
| 4,073,100 | 2/1978 | DiGiovanni, Jr. . | |
| 4,470,647 | 9/1984 | Bishoff et al. | 312/111 |
| 4,592,601 | 6/1986 | Hlinsky et al. | 312/108 X |
| 4,614,066 | 9/1986 | Koppenberg | 312/111 X |
| 4,650,261 | 3/1987 | Winter et al. | 312/140 |

*Primary Examiner*—Kenneth J. Dorner
*Assistant Examiner*—Robert J. Sandy
*Attorney, Agent, or Firm*—Basile and Hanlon

[57] ABSTRACT

A plurality of panel members are interconnected into a peripherally closed structure by elongated edge connectors to form at least one storage compartment. The panel members are of different proportional widths so as to be interconnected in various arrangements to form different sized and shaped storage compartments. Each edge connector includes a plurality of radially extending arms which are circumferentially spaced from each other to form channels to receive a side edge of a panel member therein. An end cap releasably engages an end of an edge connector to retain the panel members in each edge connector. A wall cap extends through apertures in a planar wall member into one end of an edge connector to attach the wall member to the edge connector and to close off one open end of the structure. An adapter connects two co-linear arranged edge connectors to extend the length of the structure.

24 Claims, 6 Drawing Sheets

MODULAR STORAGE APPARATUS

BACKGROUND OF THE INVENTION

1. Field of the Invention

The present invention relates, in general to shelf and storage units and, more specifically, to modular shelf and storage units.

2. Description of the Art

Modular shelving and storage units have been devised which are adjustable in size and shape as well as being able to be disassembled. Such units have been constructed with connectors which receive and connect panel members at right angles to each other to form the walls of a storage unit as well as to form one and typically many separate storage compartments within the interconnected panel members.

Such connectors have been designed with complex shapes for mounting at the corners of adjacent, perpendicularly and/or co-linearly arranged panels. However, this leaves a substantial portion of the length of each panel unconnected to adjacent panels which decreases the rigidity and strength of the resulting shelf or storage unit.

Previously devised full-length connectors typically have required grooves or slots in the edges of each panel, typically on two adjacent edges of a panel as shown in U.S. Pat. Nos. 3,975,877 and 3,836,218. However, the need to form special grooves in each panel member adds to the cost of the overall shelf or storage unit. Other storage units have complex edge connectors integrally formed thereon which, again, increases the cost of the storage unit.

Thus, it would be desirable to provide a modular storage apparatus which may be constructed of a minimum number of components which have a simple design for ease of assembly and a low manufacturing cost. It would also be desirable to provide a modular storage apparatus having these features which is also strong and rigid when assembled. Finally, it would be desirable to provide a modular storage apparatus which can be easily disassembled or rearranged in various shapes with differing numbers of individual storage compartments or overall peripheral shapes.

SUMMARY OF THE INVENTION

The present invention is a modular storage apparatus which includes a variably arrangeable number of different sized and shaped storage compartments. A plurality of planar panel members are provided, each having opposed side edges and opposed end edges surrounding opposed exterior faces. A plurality of elongated edge connectors are provided for interconnecting the planar members into a co-linear side edge-to-side edge configuration as well as into a perpendicular arrangement.

Each edge connector includes an elongated body having a length substantially equal to the length of each panel member, all of which panel members also have the same identical length. A plurality of circumferentially spaced, longitudinally extending arms are formed on the body and project radially outward from a center spine. The arms are spaced apart a predetermined distance substantially equal to the thickness of the panel members to form a channel between two adjacent arms to receive a panel member therein.

In a specific embodiment, the center spine is preferably formed of a plurality of side walls arranged in a square configuration surrounding a hollow bore extending longitudinally through the spine. The arms of each edge connector extend radially outward from a corner formed between two connected spine side walls.

Each arm on the edge connector is formed of a pair of side walls, each being co-linear with one of the side walls of the center spine. The arm side walls are disposed perpendicular to each other. An outer wall extends between the outer edges of each arm side wall and is preferably arcuate-shaped.

The interior of each arm between the side walls and the outer wall is hollow. An aperture is formed in each outer wall spaced from an end of the edge connector for receiving a lock member mounted on an end cap. The end cap has an overall diameter such that when the end cap is mounted on an edge connector, with the lock member extending through the hollow interior of an arm and engaging the aperture in the edge connector, the end cap closes off all of the ends of the channels in the edge connector to assist in securely retaining any panel members mounted in the channels in the edge connector and to provide an attractive appearance to the ends of the edge connectors.

A planar wall member may be provided for closing off one open end of the storage apparatus. A plurality of groups of apertures are formed in the wall member in a grid arrangement and are alignable with one end of edge connectors connecting a plurality of the planar members into a particular storage compartment arrangement. A wall cap including at least one and preferably a plurality of outwardly extending lock members is insertable through selected ones of the group of apertures in the wall member and into the hollow interior of certain arms of the edge connectors into engagement with the apertures spaced from one end of the edge connectors to securely mount the wall member to the edge connectors.

An optional adapter cap having a plurality of lock members extending outwardly from opposite sides of a base is mountable in one end of a first edge connector and in one end of a second end-to-end, co-linear arranged edge connector to interconnect the first and second edge connectors in a lengthwise extending arrangement. A plurality of adapter caps may be used to connect any number of end-to-end, co-linear arranged edge connectors so as to provide any desired length or depth to the storage apparatus.

The panel members are uniquely provided in at least two and preferably three sets of different widths, each different width being proportionally related to the width of other sets of panel members to enable each side wall of each individual storage compartment to be formed of different width panels employed in different numbers of panels so as to provide a large number of storage compartment sizes, shapes and assembled configurations.

The modular storage apparatus of the present invention is uniquely formed of a minimal number of components, each having a simple low-cost design, which may still be arranged in a large number of different configurations to form various sized and shaped storage compartments to suit the needs of a large number of diverse applications. The panel members of the storage apparatus are uniquely formed in proportionate widths to enable the panel members to be arranged in various interconnected groups to form a large number of different sized and shaped storage compartments within a single storage apparatus. Further, the storage apparatus may be easily extended in all directions, i.e., width, height, depth and length, by use of additional edge connectors and panel members to form any desired size and shape.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
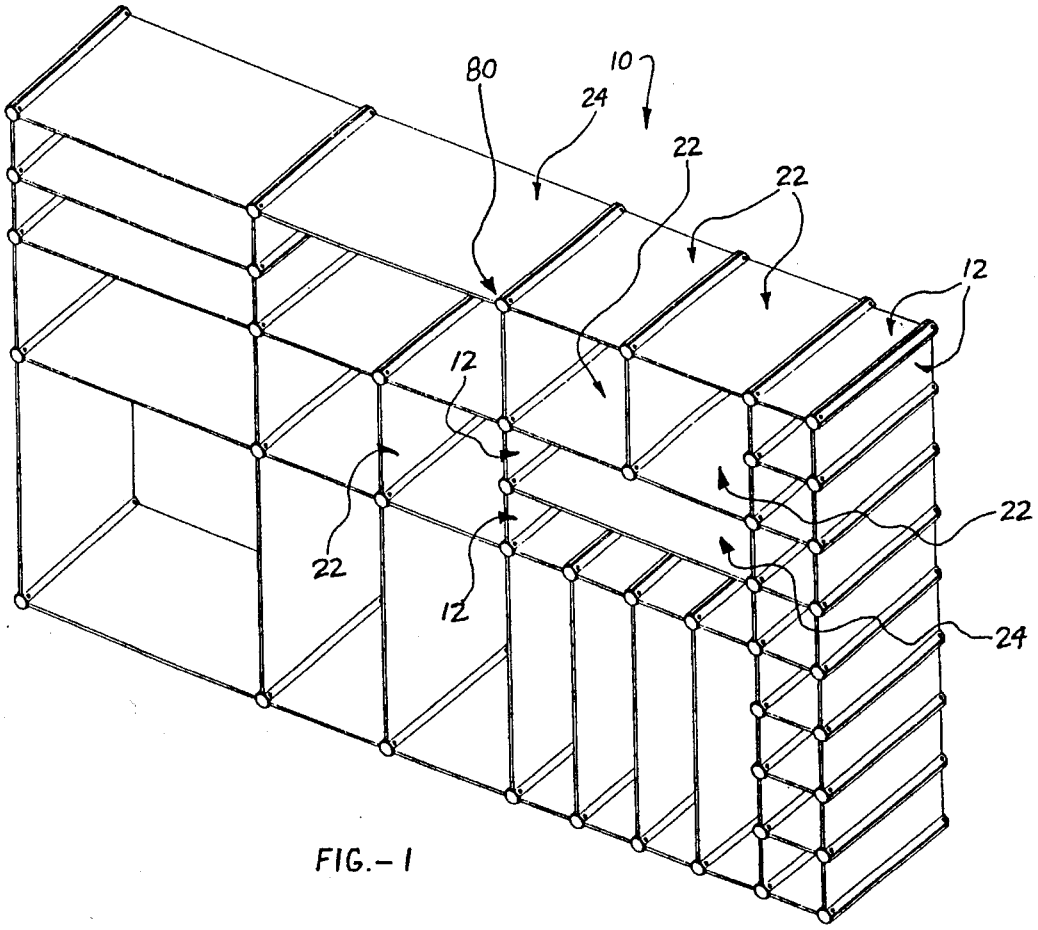
FIG. 1 is a perspective view of an example of a complete storage apparatus constructed in accordance with the teachings of the present invention.

Referring now to the drawing, and to FIG. 1 in particular, there is depicted a modular storage apparatus 10 which utilizes a minimal number of different sized and shaped components which may be arranged in numerous, different configurations to form a shelf, storage unit, etc., each containing a variably selectable number of the same or different sized individual storage compartments.

Although FIG. 1 depicts the modular storage apparatus 10 as being oriented for use as a shelf, with the edge connectors described hereafter extending substantially horizontally, and a back wall closing off one open end of each of the storage compartments formed in the storage apparatus 10, it will be understood that the entire storage apparatus 10 may be oriented in a horizontal, rather than a vertical position, with the edge connectors extending vertically and the storage compartments formed within the storage apparatus 10 open at a top end. In this orientation, the back wall functions more like a bottom wall.

Figure 3:
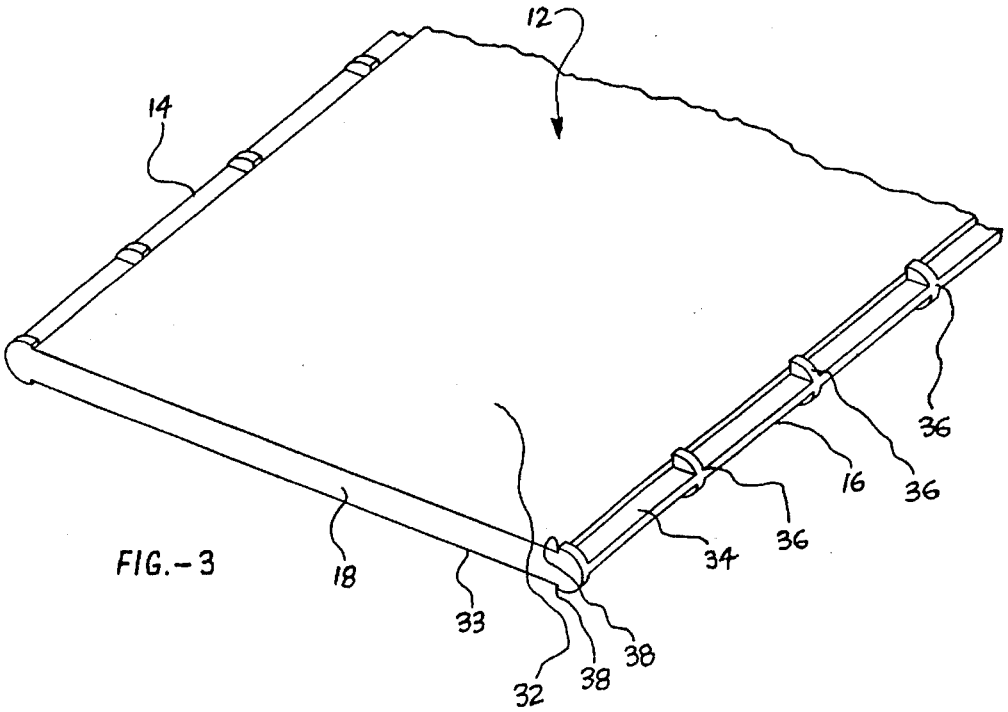
FIG. 3 is a partial perspective view of one embodiment of one of the panel members.
Figure 2:
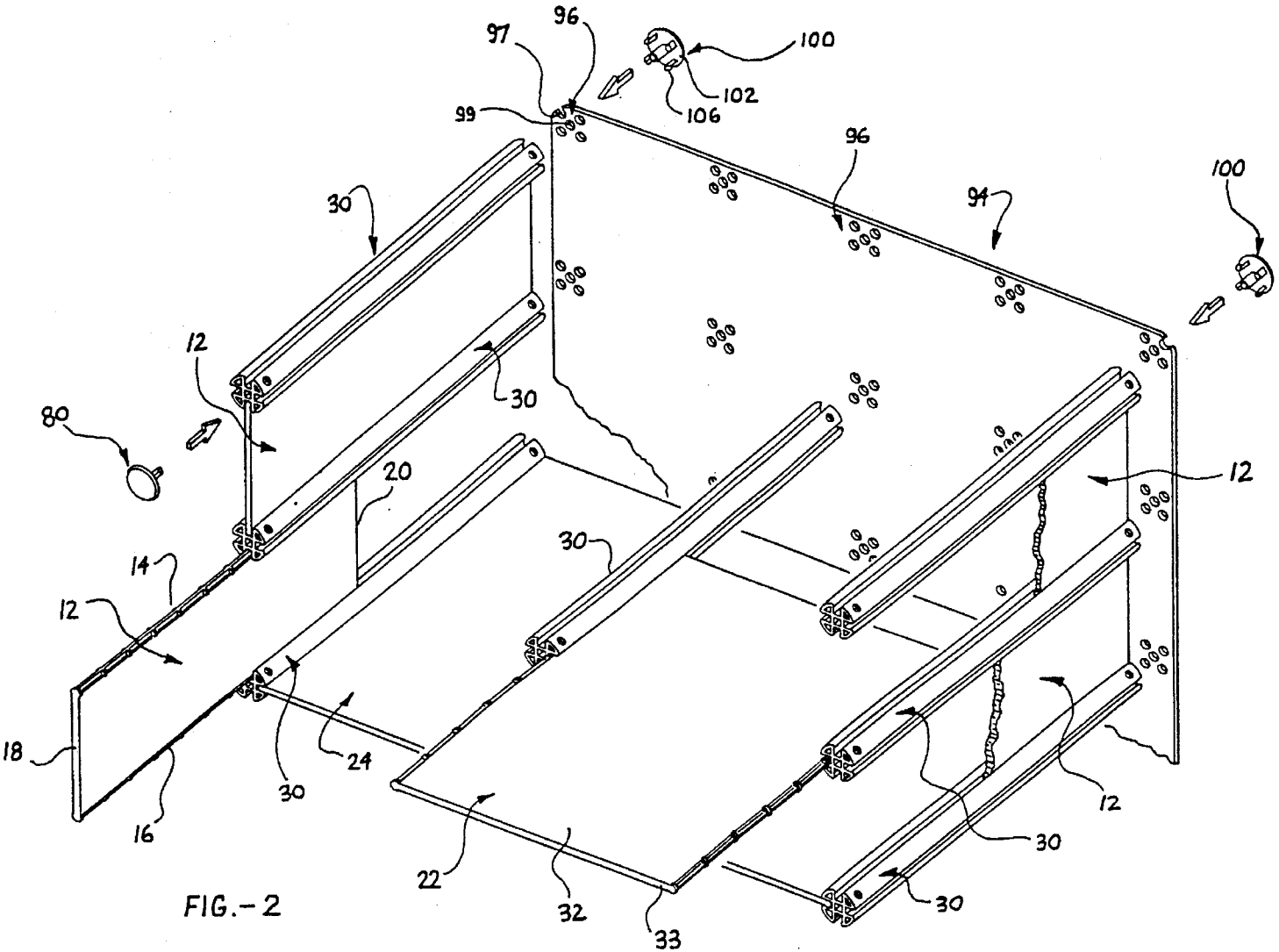
FIG. 2 is an enlarged, exploded view of a portion of the storage apparatus shown in FIG. 1, also depicting an optional back wall, a back cap or connector, and an end cap.

Referring now to FIGS. 1, 2 and 3, the storage apparatus 10 is formed of a plurality of individual panel members of three distinct sizes, each different size panel member denoted generally by reference numbers 12, 22 and 24 and employed in any desired number of individual panel members 12, 22 and 24. Each panel member 12, 22 and 24 is preferably formed of a lightweight material, such as a plastic and, more specifically, a high density polyethylene, for example. Further, each panel member 12, 22 and 24 has a generally polygonal shape, either square or rectangular, with four generally perpendicular corner edges. As shown in FIGS. 2 and 3 for panel member 12, each panel member 12 is formed with a pair of longitudinally extending opposed side edges 14 and 16, a pair of opposed end edges 18 and 20, and opposed exterior faces 32 and 33. The panel members 12, 22 and 24 are symmetrical so that they can be used in any orientation. Further, each panel member 12, 22 and 24 may be formed as an integral one-piece member, such as by injection molding, for example.

Although all of the panel members used to form the storage apparatus 10 may have the same overall size and shape, in a preferred embodiment, the storage apparatus 10 is formed of at least two and preferably three sets of different sized panel members, each set having the same length and thickness, but differing from other sets in width. Thus, three different sized panel members 12, 22 and 24, by example only, are provided in the storage apparatus 10 in various numbers and have widths which are proportional to each other so as to enable various numbers of the three different sized panel members 12, 22 and 24 to be arranged in different configurations to form various sized and shaped storage apparatus with different size and numbers of individual storage compartments formed therein.

By way of example, the panel member 12, hereafter referred to as a small panel member, has an edge-to-edge width of about 4.0 inches. A second, different sized panel member denoted by reference number 22, hereafter referred to as a medium panel member, has an side edge-to-side edge width of about 8.37 inches. The third panel member denoted by reference number 24, hereafter referred to as a large panel member, has a side edge-to-side edge width or dimension of about 17.12 inches. It will be understood that a larger number of sets of panel members with other proportional widths may also be employed.

The above described different side edge-to-side edge width dimensions of each of the panel members 12, 22 and 24 enable various numbers of small and medium panel members 12 and 22, respectively, to be connected side edge-to-side edge, as shown in FIG. 2, by elongated edge connectors denoted generally by reference number 30, to form an overall width or combined side edge-to-side edge dimension equal to that of one of the larger panel members. For example, two small panel members 12 may be arranged side edge-to-side edge as shown in FIGS. 1 and 2 and interconnected by one edge connector 30. The resultant combination of the two panel members 12 and the edge connector 30 has a combined or total side edge-to-side edge width equal to the side edge-to-side edge width or dimension of a single medium panel member 22. In addition, two medium panel members 22 may be arranged side edge-to-side edge and interconnected by a single connector member 30, as shown in FIGS. 1 and 2, to form a combined or total side edge-to-side edge width equal to the side edge-to-side edge width of a single large panel member 24. Of course, four small panel members 12 may be arranged side edge-to-side edge and interconnected at each pair of adjacent side edges by a single connector member 30, as shown in FIG. 1, to form a total side edge-to-side edge width dimension equal to the side edge-to-side edge width of a single large panel member 24.

This proportional width dimension of the various panel members 12, 22 and 24 enables such panel members 12, 22 and 24 to be rearranged in a number of different configurations as shown by way of example in FIG. 1 to form a complete storage apparatus 10 having any number of individual storage compartments formed between interconnected panel members 12, 22 and 24 which storage compartment have varying shapes or sizes.

As shown in FIG. 3, each panel member 12, as well as panel members 22 and 24, in one embodiment, has a solid planar form with substantially solid exterior faces 32 and 33 disposed between the side edges 14 and 16 and the end edges 18 and 20. Further, in a simple embodiment, each of the side edges 14 and 16 and the end edges 18 and 20 may be formed as flat edges substantially perpendicular to each other to form a regular polygonal cross section for each panel member 12, 22 and 24.

In an exemplary embodiment, however, as shown in FIG. 3, each panel member 12, 22 and 24, with the following description referring only to panel member 12, by way of example only, is formed with each side edge 14 and 16 having a generally planar, centrally located strip 34 of a narrow thickness. A plurality of arcuate-shaped flanges 36 are formed on both sides of the strip 34 and are separated by thin, planar edge strips or portions. The arcuate flanges 36 have a radius so as to extend above the top surface of the central portion of the panel member 12. This forms an arcuate or generally circular side edge, as shown in FIG. 3, and also in FIG. 7. The arcuate flanges 36 located at each panel member 12 terminate in a pair of inner shoulders 38 at the joint between the edges of each arcuate flange 36 and the adjoining exterior face 32 or 33 of each panel member 12, 22 and 24. The purpose of the shoulders 38 will become more apparent in the following description. The remaining arcuate flanges 36 spaced along each side edge 14 and 16 between the end edges 18 and 20 also terminate in shoulders adjacent the exterior faces of each panel member 12. It will be understood that the plurality of flanges 36 may be replaced by a single elongated flange extending along the entire side edge 14 and 16. Further, the continuous flange or spaced flanges 36 on the side edges 14 and 16 of each panel member 12, 22 and 24 may also be formed in any other desired shape, such as square, triangular, hexagonal, etc., it being necessary only to form the channels in the edged connectors described hereafter in a complimentary, mating shape and size to achieve a snug fit therebetween.

Figure 4:
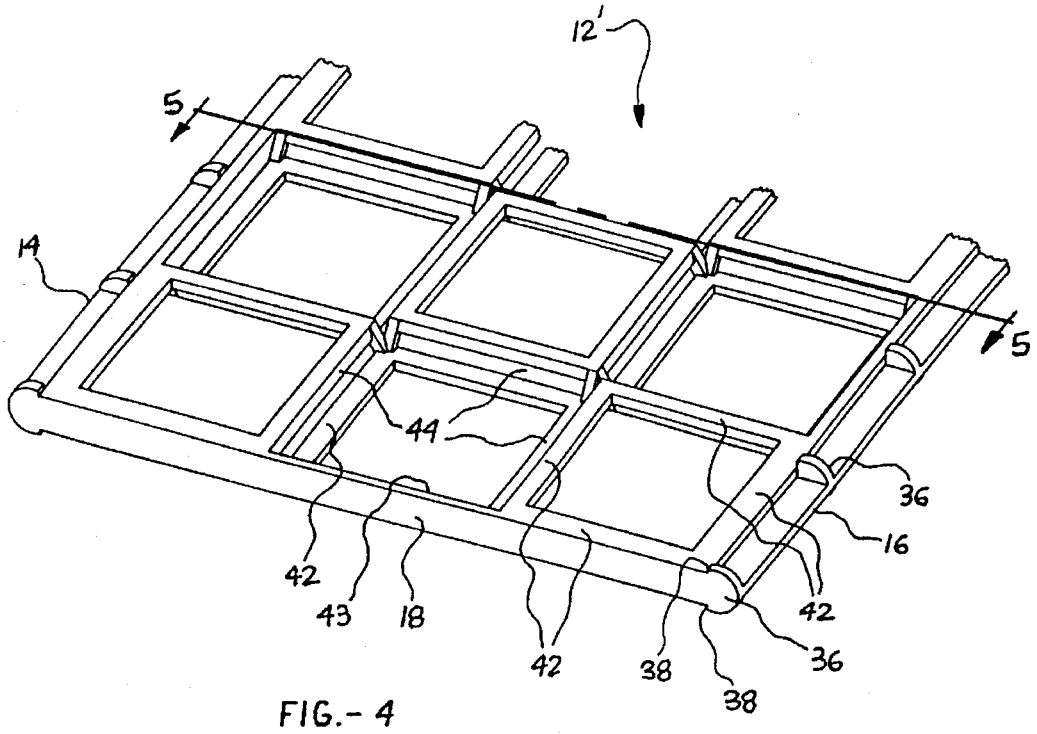
FIG. 4 is a partial perspective view of another embodiment of one of the panel members.
Figure 5:
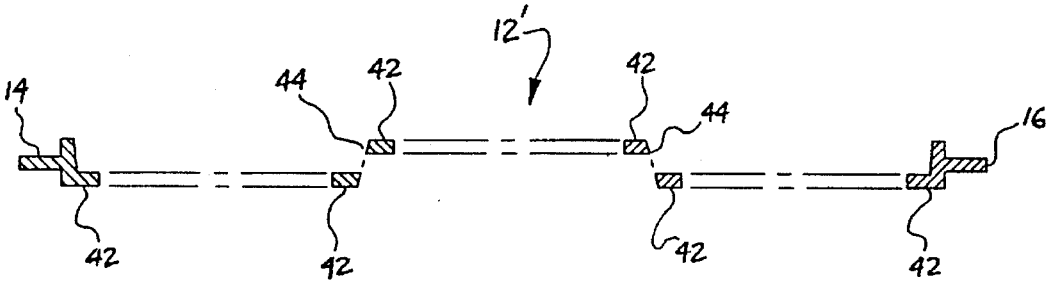
FIG. 5 is a cross sectional view generally taken along line 5—5 in FIG. 4.

Another, more preferred, embodiment of the construction of each panel member 12, 22 and 24 is shown in FIGS. 4 and 5. In this embodiment, weight reducing apertures are formed in a geometric pattern throughout the exterior faces 32 and 33 of each panel member 12, 22 and 24. The panel member 12' shown in FIGS. 4 and 5 is exemplary of the formation of the geometric pattern of apertures in any of the panel members 12, 22 and 24.

Although weight reduction for each panel member 12' may be achieved by simply forming apertures of any desired shape in each solid panel member 12', in a preferred embodiment, the apertures are formed by alternating geometric shapes, i.e, polygonal, circular, etc. with a square shape being shown as an example only. Each square geometric shape has a four-sided box-like, co-linear shape formed of four integrally interconnected side strips 42 surrounding an aperture 43. The adjacent box section is also formed of side strips 42; but extends in an opposite direction from a center plane of the panel member 12'. The side strips 42 in each box section are co-planarly arranged in each of the exterior faces 32 or 33 of the panel member 12' and interconnected by angular strips 44. This arrangement not only reduces the weight of the panel member 12' by eliminating material so as to reduce the overall cost of forming each panel member 12'; but also adds significantly to the strength and rigidity of each panel member 12' due to the alternating, geometrically arranged pattern of the geometric shapes which extend alternatingly in opposite exterior faces 32 and 33 of each panel member 12'. In addition, the geometric shapes may be solid without an interior aperture or apertures, to increase the rigidity of each panel member 12'.

Figure 6:
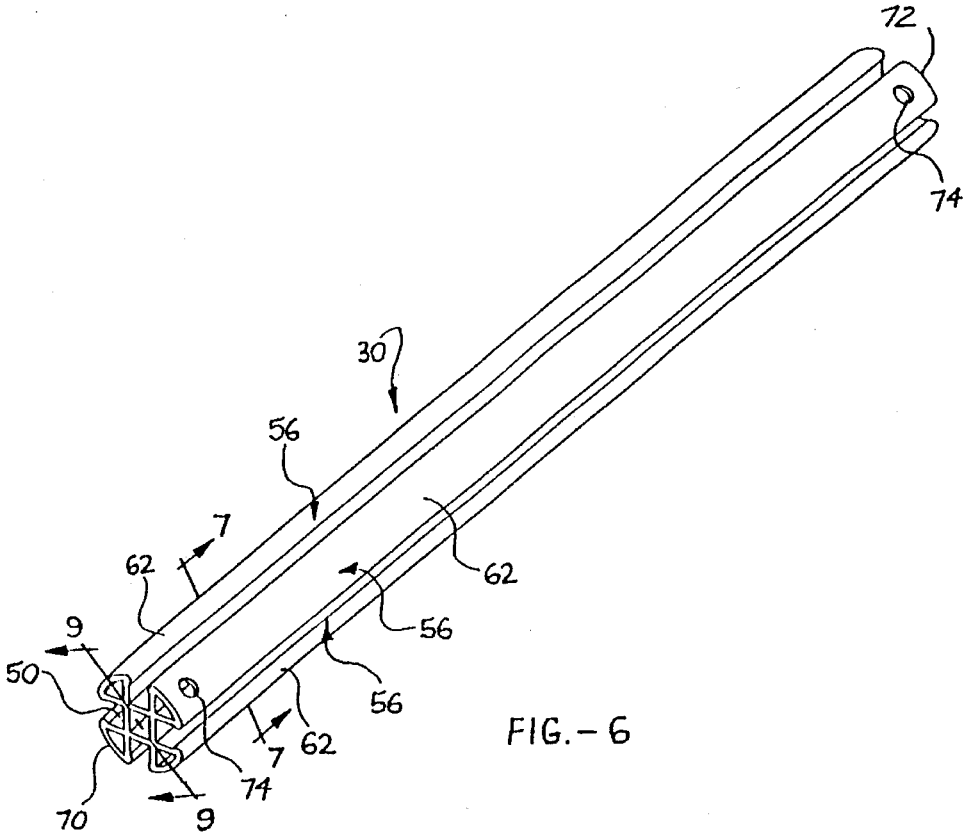
FIG. 6 is a perspective view of an edge connector.
Figure 7:
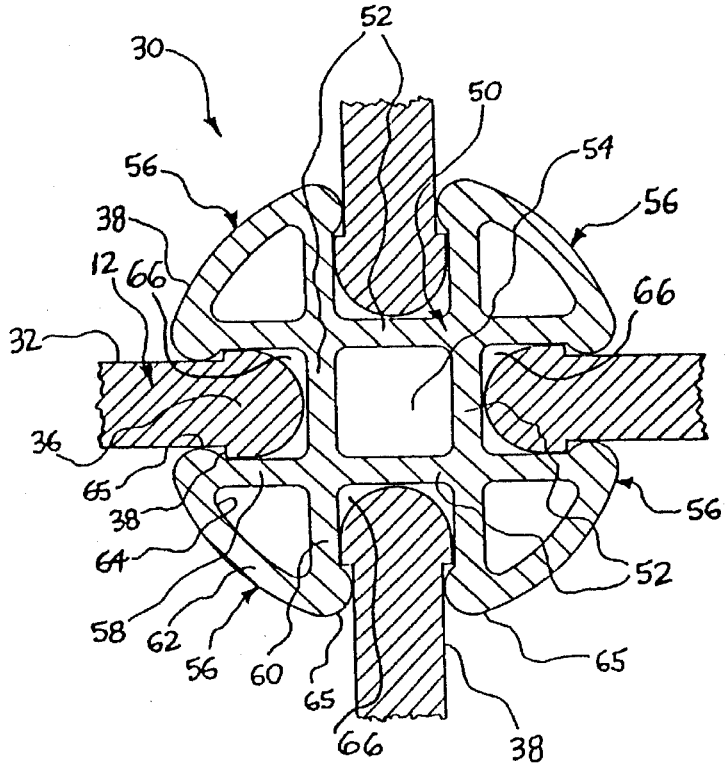
FIG. 7 is a cross sectional view generally taken along line 7—7 in FIG. 6 and showing the edge connector with a plurality of panel members mounted therein.

As shown generally in FIGS. 1 and 2, and in greater detail in FIGS. 6 and 7, the edge connector 30 is used to interconnect adjacent side edge-to-side edge arranged panel members 12, 22 and 24 as well as to connect two panel members 12, 22 or 24 disposed in a perpendicular edge arrangement. Each edge connector 30 is formed as an integral, one-piece elongated member having a length equal to the length of each of the panel members 12, 22 and 24 so as to support the interconnected panel members 12, 22 and 24 along their entire length for added strength and rigidity in the resulting complete storage apparatus 10. Each edge connector 30 may be formed of a suitable resilient material, such as a plastic, and, by way of example only, a high density polyethylene.

As shown in detail in FIG. 7, the edge connector 30 is formed with a center spine denoted generally by reference number 50. The center spine 50 may simply be an elongated solid member. However, in an exemplary embodiment, the center spine 50 is, by example, formed of four side walls, each denoted by reference number 52, which are arranged perpendicular to each other and interconnected at outer ends at corners to form a square, box-like section. In a preferred embodiment, the interior 54 of the spine 50 is hollow along the entire length of the edge connector 30. However, it will be understood that the interior 54 of the spine 50 may also be solid or provided with hollow bores extending inward only for a short distance from each opposite end of the edge connector 30.

A plurality of identically-shaped arms, each denoted by reference number 56, integrally extend outward from each corner between two of the side walls 52 of the center spine 50. In an exemplary embodiment, each arm 56 is formed of a pair of perpendicularly-arranged walls 58 and 60, each of which extends linearly from one of the side walls 52 of the center spine 50. The outer ends of the walls 58 and 60 are interconnected by an outer wall 62. Each outer wall 62, although being depicted as having a smoothly curved, arcuate shape, may also be provided in a planar or any other form or shape extending between the outer ends of the walls 58 and 60 of each arm 56. The interior portion of each arm 56 is preferably hollow along the entire length of the edge connector 30. Alternately, the entire arm 56 may be formed with a solid interior with only hollow bores extending a short distance in from each end of the edge connector 30. A lip 65 protrudes outwardly from the outer end of each of the walls 56 and 58 and extends toward a lip 65 on the adjacent, spaced arm 56 and into a channel between the two spaced arms 56.

As shown in FIG. 7, each adjacent pair of arms 56 are spaced apart such that the walls 58 and 60 of each arm 56 are spaced from an opposed wall 56 or 58 of an adjacent arm 56 to form, in conjunction with one of the walls 52 of the center spine 50, a channel denoted by reference number 66 which extends along the entire length of the edge connector 30. The channel 66 is sized to snugly, yet releasably receive the arcuate flanges 36 formed on the side edges 14 and 16 of each panel member 12, 22 and 24, as shown in FIG. 7. The shoulders 38 formed at an inner end of each arcuate flange 36 on each panel member 12, 22 and 24 releasably engage an inner surface of each lip 65 on each arm 56 to releasably retain the side edges 14 and 16 of each panel member 12, 22 and 24 in a channel 66 formed between two spaced arms 56 on the edge connector 30. As shown in FIG. 7, the four arms 56 form four, 90° spaced channels 66 so as to receive the side edges 14 or 16 of up to four individual panel members 12, 22 or 24. Since the side edges 14 and 16 of each panel member 12, 22 and 24 may have other shapes than the described and illustrated arcuate flange shape, the arms 56 on the edge connector 30 may also have other shapes to form the channel 66 to a shape and size complimentary to that of the side edges 14 and 16 of the panel members 12, 22 and 24 so as to provide a snug mounting of the panel members 12, 22 and 24 in each edge connector 30 so that the panel members 12, 22 and 24 cannot easily slide out of the edge connectors 30.

Referring again to FIG. 6, each edge connector 30 is formed with first and second spaced ends 70 and 72, respectively. An aperture 74 is formed in the first and second ends of at least one and preferably in each arm 56 of the edge connector 30 at a predetermined distance from the respective first and second ends 70 and 72 of the edge connector 30. These apertures 74 provide an interconnecting means for various other connectors as described hereafter.

As also shown in FIG. 2, there is depicted a typical assembly of the various panel members 12, 22 and 24 with assorted edge connectors 30 into a particular, exemplary storage arrangement containing a plurality of individual storage compartments, of the same or different size, between various perpendicularly and co-linearly arranged panel members 12, 22 and 24. The panel member arrangement shown in FIG. 2 is but a part of the complete storage apparatus 10 shown in FIG. 1 and generally represents an upper right portion of the storage apparatus 10 shown in FIG. 1.

It will also be understood that the panel members 12, 22 and 24 may be interconnected in any order, such that the following sequence will be understood as being exemplary only. First, a pair of edge connectors 30 are mounted on opposite side edges 14 and 16 of a large panel member 24, shown at the bottom of FIG. 2, with the side edges 14 and 16 releasably engaging one of the channels 66 in each of the edge connectors 30 in a snap-in connection. Two small panel members 12 are likewise arranged side edge-to-side edge and interconnected by a single edge connector 30. One of the small panel members 12 is then inserted into a channel 66 in the edge connector 30 attached to the large panel member 24, generally at a 90° angle with respect to the large panel member 24. Another pair of small panel members 12 interconnected by a centrally disposed edge connector 30 are likewise assembled and mounted in the edge connector 30 on the opposite side edge of the large panel 24.

Next, a pair of medium panel members 22, only one being shown, are arranged side edge-to-side edge and interconnected by a single edge connector 30. The outer side edges of the interconnected pair of medium panel members 22 are then inserted into the centrally located edge connectors 30 between the vertically extending pairs of small panel members 12 mounted on each side edge 14 and 16 of the large panel member 24. Additional edge connectors 30 may be mounted on the upper end of the uppermost pair of small panel members 12 to receive an additional pair of medium panel members 22 interconnected by a central edge connector, not shown.

Due to the proportional widths of the various panel members 12, 22 and 24 described above, the same configuration shown in FIG. 2 may also be achieved by the use of different sized panel members 12, 22 and 24. Thus, for example, a single medium panel member 22 can be used in place of the pair of interconnected small panel members 12 on each side edge of the large panel member 24. In addition, four small panel members 12 interconnected by three edge connectors 30 may be used instead of two edge connected medium panel members 22. Finally, a single large panel member 24 may replace the two edge connected medium panel members 22.

This alternate use of different panel members 12, 22 and 24 achieves the same number and shape storage compartments between the various interconnected panel members. It will be understood that a different number and different shaped storage compartments may also be formed in the storage apparatus 10 by use of different sized panel members 12, 22 and 24 as shown in the complete storage apparatus 10 in FIG. 1.

Figure 8:
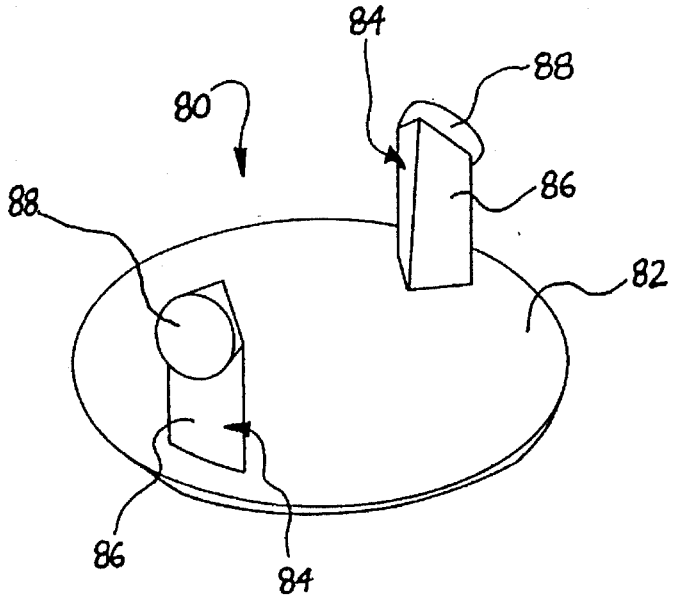
FIG. 8 is a perspective view of an end cap.
Figure 9:
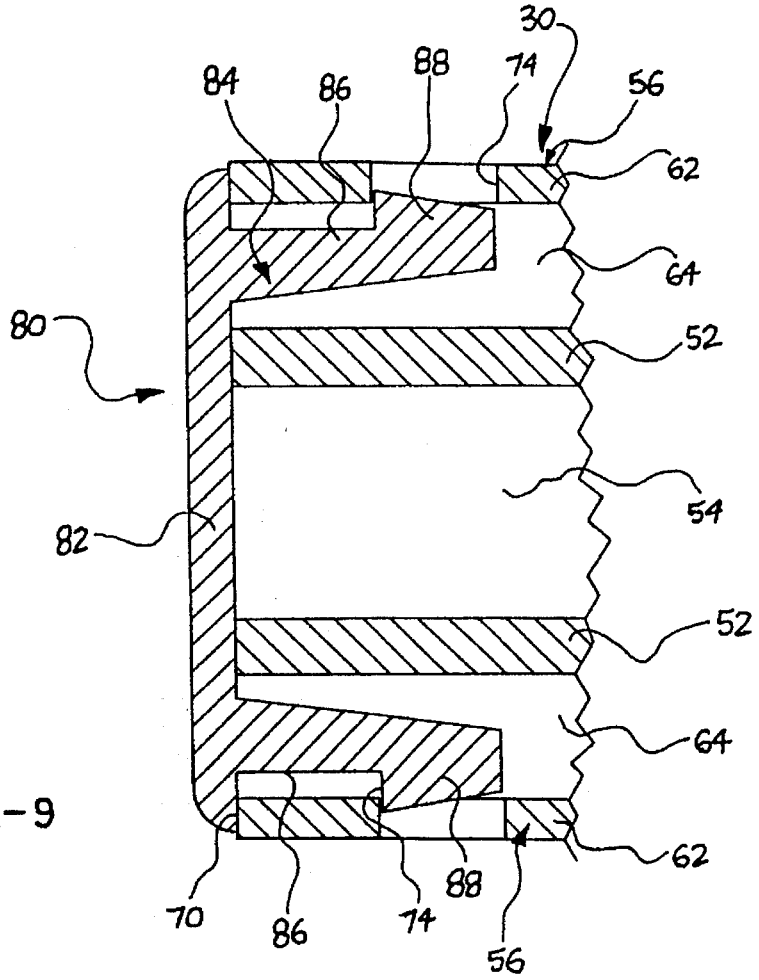
FIG. 9 is a cross sectional view generally taken along line 9—9 in FIG. 6 and showing an end cap, depicted in FIG. 8, mounted in one end of an edge connector.

As shown generally in FIGS. 1 and 2, and in greater detail in FIGS. 8 and 9, the storage apparatus 10 is provided with an end cap 80 designed to close the ends 70 and 72 of each edge connector 30 to securely retain any of the panel members 12, 22 and 24 mounted in a particular edge connector 30 without permitting the panel members 12, 22 and 24 to slide out of the edge connectors 30. The end cap 80, of course, can be removed to enable any of the panel members 12, 22 and 24 to be removed or inserted into an edge connector 30.

The end cap 80 is formed of a suitable resilient material, such as a plastic, for example, a high density polyethylene. The end cap 80 includes a planar disk-like base 82 which has an outer diameter substantially equal to the outer diameter of the edge connector 30 between the outer surface of diametrically opposed outer walls 62 of the edge connector 30. It will be understood that the base 82 of the end cap 80 may be provided in other shapes, such as square, rectangular, etc., as long as it is formed in a sufficient overall size so as to close off the ends of the channels 66 formed between adjacent arms 56 on each edge connector 30.

At least one and preferably a plurality of lock members are formed on one surface of the base 82 and project outward therefrom. Two lock members 84 are shown in FIG. 8 by way of example. Each lock member 84 is formed of a stem 86 which has, by way of example only, a triangular cross section. A circular tab 88 is integrally formed on the end of the stem 86 and has an outer diameter sized to releasably engage one of the apertures 74 formed in the arms 56 at the opposite ends 70 and 72 of an edge connector 30.

Two diametrically opposed lock members 84 are shown in FIG. 8 for engaging the apertures 74 on two diametrically opposed arms 56 at one end of an edge connector 30. It will be understood that one or two additional lock members 84 may also be mounted on the base 82 of the end cap 80 to engage the apertures 74 in the other arms 56 at one end 70 or 72 of an edge connector 30.

As shown in FIG. 9, the end cap 80 is mounted in one end, such as the first end 70 of an edge connector 30, with the stems 86 of the lock members 84 extending through the open bore 64 formed in each arm 56 of the edge connector 30. The end cap 80 is inserted into the first end 70 of the edge connector 30 until the base 82 of the end cap 80 engages the first end 70 of the edge connector 30. In this position, the tabs 88 on each stem 86 snap into the aperture 74 formed in one of diametrically opposed arms 56 of the edge connector 30. In this mounting position, the base 82 of the end cap 80 covers or closes off the end of each channel 66 formed between adjacent pairs of arms 56 on the edge connector 30 and firmly retains the panel member 12, 22 or 24 inserted into each channel 66 within the edge connector 30. Inward force exerted on the tabs 88 causes the tabs 88 and the stems 86 of the lock members 84 to bend inward within the open bore 64 in each arm 56 of the edge connector 30 until the tabs 88 clear the apertures 74 thereby enabling the end cap 80 to be separated from the edge connector 30.

Although not shown in FIG. 2, it will be understood that an end cap 80 may be mounted on each end 70 of 72 of each edge connector 30 which has at least one panel member 12, 22 or 24 mounted therein.

As shown in FIG. 2, the storage apparatus 10 of the present invention may be provided with an optional planar wall member 94 for closing one open end of the storage apparatus 10. As noted above, in the exemplary vertical orientation of the storage apparatus 10 shown in FIG. 1 and 2, the wall member 94 functions as a back wall. However, in a horizontal orientation of the storage apparatus 10, the wall member 94 more properly functions as a base or bottom wall.

The wall member 94 has a generally planar shape of any predetermined size and is formed of a suitable material, such as high density polyethylene, for example. The wall member 94 is illustrated by example as having a size equal to a box formed of four large panel members 24 arranged 90° to each other. Other sized wall members 94 or a plurality of the same size wall members 94 may be used as needed to close the entire open end of the storage apparatus 10.

A plurality of groups of apertures, each group being denoted generally by reference number 96, are formed in a grid pattern across the surface of the wall member 94. Each group of apertures 96 is located at a position to align with one end of an edge connector 30, with the groups of apertures being provided in a sufficient number on the back wall 94 to receive the maximum number of small panel members 12 which can be interconnected together across the entire surface of the wall member 94. Thus, by way of example, the wall member 94 is provided with a 5×5 grid arrangement of groups 96 of apertures. Other grid arrangements may also be possible depending upon the overall size of the wall member 94. Each group 96 of apertures includes a central larger diameter aperture 99 surrounded by four equi-circumferentially spaced, smaller diameter, apertures 97 arranged in a circle.

Figure 10:
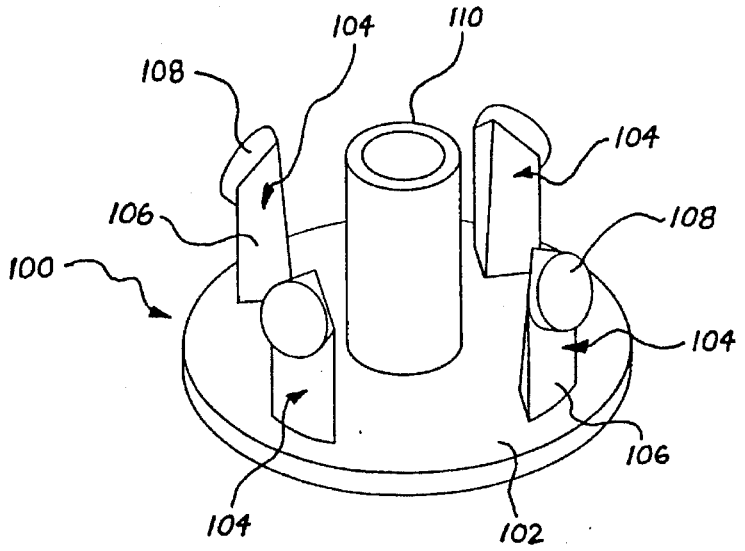
FIG. 10 is a perspective view of a back cap.

A wall cap 100, shown generally in FIG. 2 and in greater detail in FIG. 10, is provided to releasably mount the wall member 94 to one of the edge connectors 30 associated therewith, with the number of wall caps 100 being used depending on the number of edge connectors 30 facing the wall member 94. The wall cap 100 is similar to the end cap 88 and includes a planar disk-like base 102 from which a plurality of lock members 104 extend. Each lock member 104 is formed of an elongated stem 106 which terminates in a generally circular-shaped tab 108. The wall cap 100 also includes a center, generally cylindrical locating stem 110 which may be solid or, as shown in FIG. 10, of a hollow construction. The stem 110 is centrally located on the base 102 and is designed to engage the opening 54 in the center spine 50 of one of the edge connectors 30.

With the wall member 94 located in a proper position with respect to the interconnected panels 12, 22 and 24 and edge connectors 30, as shown by way of example in FIG. 2, a plurality of wall caps 100 are inserted through the appropriate groups of apertures 96, with the stem 110 extending through the central aperture 99 and the lock arms 104 projecting through the apertures 97 into the aligned end of an edge connector 30 until the tabs 108 snap into the apertures 74 formed at the second end 72 of each edge connector 30. This process is repeated for other wall caps 100 to firmly mount the wall member 94 to all of the edge connectors 30 interconnecting the various panel members 12, 22 and 24 together.

Figure 11:
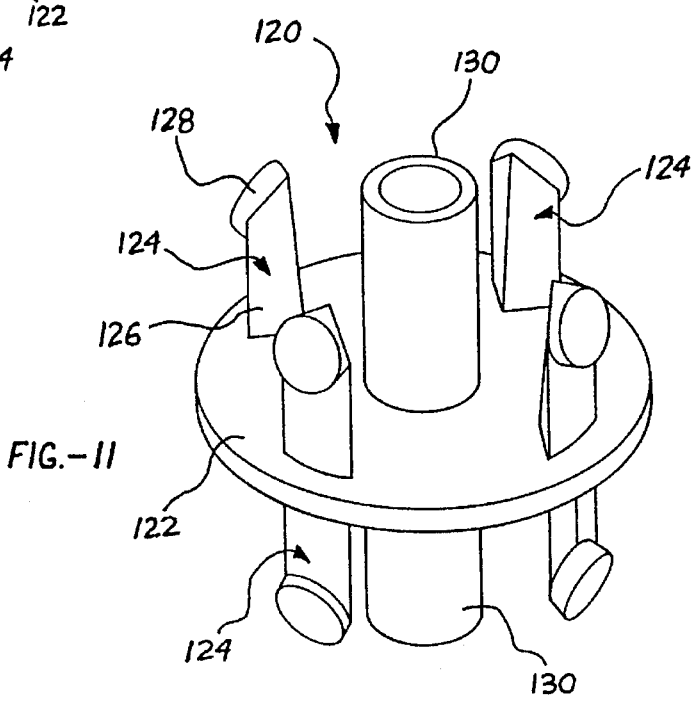
FIG. 11 is a perspective view of an adapter cap.

As shown in FIG. 11, the storage apparatus 10 of the present invention may be provided with an optional adapter cap denoted generally by reference number 120 which is used to extend the overall length or depth of the storage apparatus 10. The adapter cap 120 is formed of a suitable resilient material, such as a high density polyethylene. In the same manner as the end cap 88 and the wall cap 100, the adapter cap 120 includes a generally planar, circular-shaped base 122. A plurality of circumferentially spaced, outwardly extending lock members 124 are formed on each opposed surface of the base 122 and project outward from both sides of the base 122. Each lock member 124 is formed of a stem 126 which terminates in an outer, generally circular-shaped tab 128. A generally cylindrical, hollow stem 130 is also formed on and extends outward from each side of the base 122 and is located centrally between the circumferentially spaced, outer disposed lock members 124.

Figure 12:
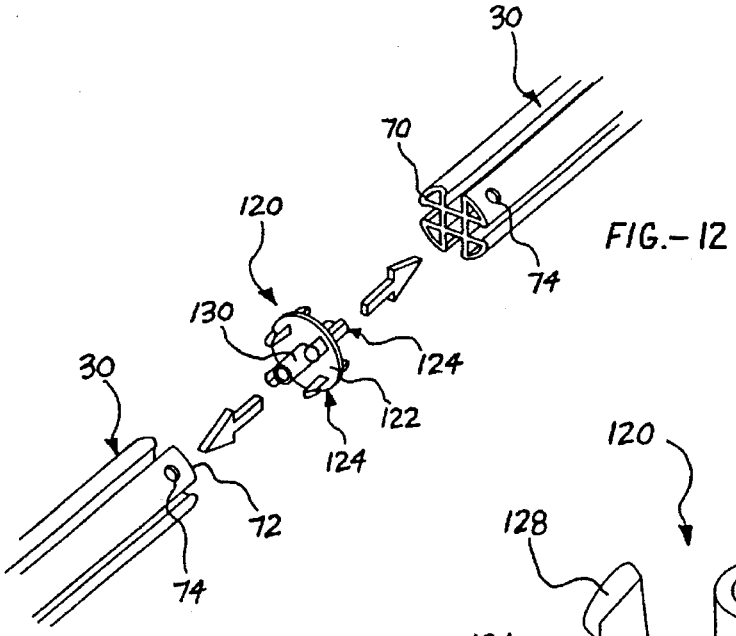
FIG. 12 is a perspective view depicting the use of the adapter cap shown in FIG. 11 interconnecting two end-to-end arranged edge connectors.

As shown in FIG. 12, the adapter cap 120 is designed to releasably engage the ends of two end-to-end lengthwise-arranged edge connectors 30, with the lock members 124 on one side of the base 122 of the adapter cap 120 being releasably insertable into the bores in each arm 56 of the edge connector 30 until the tabs 128 on each arm 124 snap into the apertures 74 spaced a short distance from the second end 72 of the edge connector 30. Another edge connector 30 is then inserted over the lock members 124 projecting outward from the opposite side of the base 122 of the adapter cap 120 until the tabs 128 on the lock arms 124 snap into the apertures 74 spaced from the first end 70 of the other edge connector 30. In this manner, the use of one adapter cap 120 enables the length or depth of the storage apparatus 10 to be doubled by connecting two edge connectors 30 in a lengthwise extending, end-to-end arrangement. Additional adapter caps 120 and additional end-to-end arranged edge connectors 30 may also be interconnected in the same manner to extend the length or depth of the storage apparatus 10 to any desired dimension.

In summary, there has been disclosed a unique storage apparatus which is modular in form and which includes a minimal number of components which may be interconnected in a large number of different arrangements to form different sized and shaped, as well as numbers of individual storage compartments within the storage apparatus. The panel members and edge connectors may also be employed in sufficient numbers to extend any or all of the width, height, depth or length dimensions of the storage apparatus to any desired size to suit the needs of a particular application. The unique proportional width of the plurality of panel members of the storage apparatus enables the panel members to be interconnected in various configurations to form the differing numbers and sizes of storage compartments to suit any need or application. Further, the components of the storage apparatus are formed of lightweight, low cost plastic which contributes to a low cost for the versatile storage apparatus of the present invention. Finally, the panel members snugly engage the edge connectors and are retained therein without sliding out from the edge connectors.

What is claimed is:

1. A modular storage apparatus comprising:

a plurality of planar panel members each having opposed side edges and opposed end edges surrounding opposed exterior faces; and a plurality of edge connectors capable of interconnecting the side edges of a plurality of adjacent disposed panel members into a peripherally closed structure having at least one storage compartment formed between the panel members;

each edge connector including:

an elongated body having a central, elongated spine and a plurality of circumferentially spaced, longitudinally extending arms extending radially outward from the central spine, the arms being spaced apart to form channels between adjacent arms complementary to the shape of the side edges of the panel members for receiving a side edge of a panel member therein;

the arms further including a pair of arm side walls joined at a common edge to the central spine and having outer edges circumferentially spaced from each other; and an outer wall extending and connected between the outer edges of each of the arm side walls.

2. The modular storage apparatus of claim 1 wherein the outer wall is arcuate shaped.

3. The modular storage apparatus of claim 1 wherein an interior of each arm between the pair of arm side walls and the outer wall is hollow, at least for a predetermined distance extending from each end of the edge connector.

4. A modular storage apparatus comprising:

a plurality of planar panel members each having opposed side edges and opposed end edges surrounding opposed exterior faces; and a plurality of edge connectors capable of interconnecting the side edges of a plurality of adjacent disposed panel members into a peripherally closed structure having at least one storage compartment formed between the panel members;

each edge connector including:

an elongated body having a plurality of circumferentially spaced, longitudinally extending arms, the arms being spaced apart to form channels between adjacent arms complementary to the shape of the side edges of the panel members for receiving a side edge of a panel member therein, and a projection formed on and extending circumferentially outward from each arm of the edge connector into the channel formed between adjacent arms.

5. A modular storage apparatus comprising:

a plurality of planar panel members each having opposed side edges and opposed end edges surrounding opposed electric faces; and a plurality of edge connectors capable of interconnecting the side edges of a plurality of adjacent disposed panel members into a peripherally closed structure having at least one storage compartment formed between the panel members;

each edge connector including:

an elongated body having a centrals elongated spine and a plurality of circumferentially spaced, longitudinally extending arms extending radially outward from the central spine, the arms being spaced apart to form channels between adjacent arms complementary to the shape of the side edges of the panel members for receiving a side edge of a panel member therein;

the central spine including:

four interconnected side walls disposed 90° apart with respect to each other;

a corner formed at each juncture of two interconnected side walls; and one arm joined to and extending radially outward from each corner of the central spine.

6. The modular storage apparatus of claims 5 wherein each arm further comprises:

a pair of arm side walls, each arm side wall being co-linear with one of the side walls of the central spine.

7. The modular storage apparatus of claim 5 further comprising:

an aperture formed in the outer wall of at least one arm of each edge connector and spaced from an end of each edge connector, the aperture communicating with the hollow interior of the one arm.

8. The modular storage apparatus of claim 7 further comprising:

an end cap having at least one lock member extending therefrom insertable into the interior of one of the arms on one of the edge connectors; and an outer end of the lock member being releasably insertable into the aperture in the outer wall of an arm of one of the edge connectors to releasably mount the end cap to the one edge connector, the end cap covering the center spine and ends of the channels in the one edge connector.

9. The modular storage apparatus of claim 7 further comprising:

an end cap having a plurality of spaced lock members extending therefrom, each insertable into the interior of one of the arms on one of the edge connectors; and an outer end of each lock member being releasably insertable into the aperture in the outer wall of an arm of one of the edge connectors to releasably mount the end cap to the one edge connector, the end cap covering the center spine and ends of the channels in the one edge connector.

10. The modular storage apparatus of claim 3 further comprising:

an end cap mountable in an end of one of the edge connectors and closing off the channels in the one edge connector to retain any panel members mounted in the channels in the one edge connector.

11. The modular storage apparatus of claim 10 further comprising:

means, formed on the end cap, for releasably locking the end cap in an end of the one edge connector.

12. A modular storage apparatus comprising:

a plurality of planar panel members each having opposed side edges and opposed end edges surrounding opposed exterior faces;

a plurality of apertures formed in the exterior faces of each panel member; and a plurality of edge connectors capable of interconnecting the side edges of a plurality of adjacent disposed panel members into a peripherally closed structure having at least one storage compartment formed between the panel members;

each edge connector including;

an elongated body having a plurality of circumferentially spaced, longitudinally extending arms, the arms being spaced apart to form channels between adjacent arms complementary to the shape of the side edges of the panel members for receiving a side edge of a panel member therein.

13. A modular storage apparatus comprising:

a plurality of planar panel members each having opposed side edges and opposed end edges surrounding opposed exterior faces;

a plurality of integral geometric shapes forming the exterior faces of each panel member, adjacent geometric shape extending to opposite exterior faces of each panel member to form a geometric pattern of raised and recessed geometric shapes in the exterior faces of each panel member; and a plurality of edge connectors capable of interconnecting the side edges of a plurality of adjacent disposed panel members into a peripherally closed structure having at least one storage compartment formed between the panel members;

each edge connector including:

an elongated body having a plurality of circumferentially spaced, longitudinally extending arms, the arms being spaced apart to form channels between adjacent arms complementary to the shape of the side edges of the panel members for receiving a side edge of a panel member therein.

14. A modular storage apparatus comprising:

a plurality of planar panel members each having opposed side edges and opposed end edges surrounding opposed exterior faces;

the opposed side edges of each panel member terminating in an arcuate-shaped edge, each arcuate-shaped edge formed of a plurality of arcuate-shaped flanges spaced along each side edge of each panel member and planar side edge portions disposed between the arcuate-shaped flanges; and a plurality of edge connectors capable of interconnecting the side edges of a plurality of adjacent disposed panel members into a peripherally closed structure having at least one storage compartment formed between the panel members;

each edge connector including:

an elongated body having a plurality of circumferentially spaced, longitudinally extending arms, the arms being spaced apart to form channels between adjacent arms complementary to the shape of the side edges of the panel members for receiving a side edge of a panel member therein.

15. The modular storage apparatus of claim 14 wherein each arcuate-shaped flange terminates in a pair of opposed shoulders extending to the adjacent exterior face of each panel member.

16. The modular storage apparatus of claim 4 further comprising:

the panel members being provided in at least first and second groups of panel members, each panel member in each of the respective first and second group being identical to the other panel members in a respective group, the width of the panel members in the first group being proportional to the width of the panel members in the second group such that the total width of two panel members of the first group interconnected co-planarly by one edge connector equalling the width of one of the panel members of the second group.

17. The modular storage apparatus of claim 16 further comprising:

a third group of panel members, each having identical widths proportional to the width of the panel members of the second group of panel members such that the total width of two panel members of the second group interconnected co-planarly by one edge connector equals the width of one of the panel members of the third group of panel members.

18. The modular storage apparatus of claim 3 further comprising:

a planar wall member;

a wall cap having at least one lock member extending therefrom;

an aperture formed in the wall member;

the lock member on the wall cap extending through the aperture in the wall member into one of the arms of one of the edge connectors to attach the wall member to the one edge connector.

19. The modular storage apparatus of claim 18 further comprising:

means, formed on the wall cap, for releasably locking the wall cap to one of the arms of one of the edge connectors.

20. The modular storage apparatus of claim 7 further comprising:

a planar wall member;

a wall cap having at least one lock member extending therefrom;

an aperture formed in the wall member;

the lock member on the wall cap extending through the aperture in the wall member into one of the arms of one of the edge connectors and engaging the aperture in the one arm of the one edge connector to attach the wall member to the one edge connector.

21. The modular storage apparatus of claim 20 further comprising:

a plurality of apertures forming in a grid arrangement across the wall member, each aperture capable of receiving a lock member of one of a plurality of wall caps for attaching the wall member to a plurality of edge connectors.

22. The modular storage apparatus of claim 20 further comprising:

a plurality of lock members are spaced apart on the wall cap; and a plurality of apertures formed in a group on the wall member complimentarily arranged to the plurality of lock members on the wall cap, each aperture receiving a lock member therethrough.

23. The modular storage apparatus of claim 3 further comprising:

an adapter cap having at least one lock member extending outward from each opposite side of a base;

the at least one lock member releasably engaging an arm in one of a pair of end-to-end, co-linear arranged edge connectors to interconnect the pair of edge connectors in a single, lengthwise arrangement.

24. The modular storage apparatus of claim 7 further comprising:

an adapter cap having at least one lock member extending outward from each opposite side of a base;

the at least one lock member releasably engaging the aperture in an arm in one of a pair of end-to-end, co-linear arranged edge connectors to interconnect the pair of edge connectors in a single, lengthwise arrangement.

* * * * *

UNITED STATES PATENT AND TRADEMARK OFFICE

CERTIFICATE OF CORRECTION

PATENT NO. : 5,466,057

DATED : November 14, 1995

INVENTOR(S) : Karl Blankenburg

It is certified that error appears in the above-indentified patent and that said Letters Patent is hereby corrected as shown below:

Column 4, lines 61 and 62, delete "compartment" and insert --compartments--.

Column 12, line 2, delete "5" and insert --3--.

Signed and Sealed this

Second Day of April, 1996

Bruce Lehman

*Attest:*

BRUCE LEHMAN

*Attesting Officer*

*Commissioner of Patents and Trademarks*